United States Patent [19]

Schaefer

[11] Patent Number: 4,461,418

[45] Date of Patent: Jul. 24, 1984

[54] FASTENER DRIVING TOOL

[76] Inventor: Jeffrey T. Schaefer, Rte. 4,, Waupaca, Wis. 54981

[21] Appl. No.: 325,544

[22] Filed: Nov. 27, 1981

[51] Int. Cl.[3] ..... B25C 1/02

[52] U.S. Cl. ..... 227/147; 29/516; 145/46

[58] Field of Search ..... 173/132; 227/147; 145/46; 81/436; 30/367; 29/516, 517; 384/296, 300

[56] References Cited

U.S. PATENT DOCUMENTS

| | | | |
|---|---|---|---|
| 913,014 | 2/1909 | Kafer | 227/147 |
| 1,575,582 | 3/1926 | Joy | 227/147 |
| 2,199,833 | 5/1940 | Fleischman | 227/147 |
| 2,229,868 | 1/1941 | Newell, Sr. | 227/147 |
| 2,666,677 | 1/1954 | Miller | 29/516 X |
| 2,896,209 | 7/1959 | Hilt | 227/147 |
| 3,060,440 | 10/1962 | Pfaff et al. | 227/147 |
| 3,119,423 | 1/1964 | Weick | 227/147 X |
| 3,147,484 | 9/1964 | Nelson | 227/147 X |
| 3,342,228 | 9/1967 | Reid | 227/147 |
| 3,934,779 | 1/1976 | Dent | 227/147 |
| 3,979,040 | 9/1976 | Denin | 227/147 X |
| 4,179,058 | 12/1979 | Yost | 227/147 |

*Primary Examiner*—James M. Meister

*Attorney, Agent, or Firm*—Russell L. Johnson

[57] ABSTRACT

A fastener driving tool of unitary construction. The tool is characterized by a tubular grip having a fastener driving ram slidably disposed in the tube and a frictional element which maintains frictional engagement between the grip and the ram. The frictional element serves to prevent the ram from rebounding out of contact with the fastener after a blow is struck. The blow receiving end of the ram is of greater diameter than the inside diameter of the grip and comes in contact with the grip when the fastener driving end of the ram has reached the opposite end of the grip. This arrangement permits the user to determine the length of travel remaining before the fastener will be fully driven. The unitary construction of the driver is achieved by forming a detent in the grip after the grip, the ram, and the frictional element are assembled.

4 Claims, 4 Drawing Figures

FASTENER DRIVING TOOL

BACKGROUND OF THE INVENTION

The driving of fasteners such as nails and the like in inaccessible areas and the driving of fasteners into finished and easily marred surfaces without marring the surface has long been a problem to those who must drive fasteners in such circumstances. Where economics permit, specialty tools have been developed and are in use to meet the requirements of specific problems. Examples of such drivers are upholstery tools and picture framing tools. However, such tools are limited in the scope of the applications in which such tools will serve satisfactorily. A general utility tool for driving fasteners such as nails has not found acceptance in the art.

DISCUSSION OF THE PRIOR ART

The term "unitary construction" as used herein shall be read to include the meaning "incapable of being nondestructively disassembled".

The patent files possess an abundance of prior art which teach similar fastener drivers for driving nails and the like. Many of the prior art devices employ a gripping tube with a ram which is coaxial with the tube. The ram is withdrawn and a fastener is inserted into the gripping tube. The ram is driven forward and the fastener is driven by contact with the ram. The number of patents issued for such tools is witness to the fact that there has long been a need for such a tool. Many attempts by those skilled in the art have been made to respond to that need. The absence of widespread acceptance in the art of any of the proposed devices is witness to the general failure of the prior art devices to satisfy the long felt needs for such a tool.

Many, if not most, of these prior art devices will achieve their intended purposes and achieve the end results sought. The reasons for their failure to find acceptance in the art and to achieve commercial success can only be speculated upon. However, some of the deficiencies of these prior art devices can be fairly soundly surmised. In order to be acceptable in the art a driving tool of the type contemplated by this invention must not only perform its intended tasks but the tools must do so to the convenience of the user.

Prior art drivers such as those of U.S. Pat. Nos. 3,934,779 to Dent and 4,120,438 to Litch are of a size and shape such that they cannot be conveniently carried in a tool tray, pocket, pouch, or apron and therefore are not convenient for the user to have with him at the point of use when the need for such a tool arises.

Prior art drivers such as those taught by U.S. Pat. Nos. 2,839,754 to Pfaff, 4,179,058 to Yost, and 3,119,423 to Weick all possess parts that are of a nature that can become detached from one another and/or can become out of working order due to misalignment or small amounts of foreign matter entering the tool. A tool which does not remain in working order under the harsh working conditions to which a tool of the sort contemplated will encounter will not find ready acceptance in the art. For example, tools such as those taught by U.S. Pat. Nos. 3,342,228 to Reid and 3,979,040 to Denin wherein magnets are used to maintain contact between the ram and the fastener are counter indicated in the art. The magnets do not serve for aluminum or brass fasteners and they tend to attract small metal particles and objects which must be removed from the tool in order to maintain the operability of the tool.

It is therefore an object of this invention to provide a fastener driving tool which is of unitary construction and which is sufficiently durable to withstand the harsh treatment to which it will be subjected in use.

It is further an object of this invention to provide a fastener driving tool which enables the driving of nails into hard woods and the like without the bending of the nail due to blows striking the head of the nail off center, and further to enable the driving of fasteners at locations where a direct blow of a hammer against the fastener is difficult or impossible to achieve.

It is further an object of this invention to provide such a tool which is of a shape and size which can readily be carried in a tool carrier, apron, or pocket so as to be readily at hand at the time of need.

It is further an object of this invention to provide a tool as described above wherein the tool is of low cost and serves a wide range of general applications.

It is further an object of this invention to provide a tool as described above wherein the ram remains in contact with the fastener and the distance that the fastener has been driven and remains to be driven can be readily ascertained by the user.

Other objects will become apparent from the drawings, specifications and claims.

BRIEF DESCRIPTION OF THE INVENTION

The invention in its simplest form is a fastener driving tool of unitary construction and which is characterized by an elongate tubular grip, a ram which is coaxial with the grip and a frictional element which provides frictional contact between the grip and the ram and the elements are maintained in unitary assembly with each other by means of an integral detent formed in the grip and which permits the travel of the ram while barring the disassociation of the grip, ram and frictional element.

DETAILED DESCRIPTION OF THE INVENTION

In the figures like numbers refer to like elements.

Figure 1:
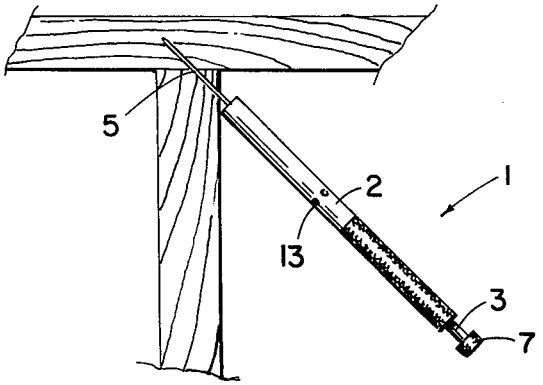
FIG. 1 is an elevational view showing the tool of this invention in use.
Figure 2:
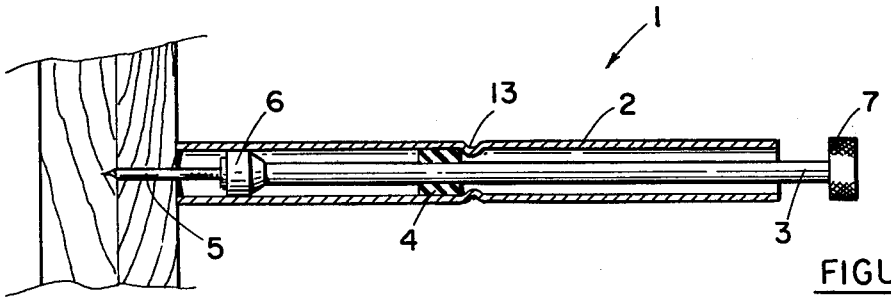
FIG. 2 is a sectional view of the tool of FIG. 1 preparatory to driving a fastener.

Referring now to FIGS. 1 through 4. Fastener driving tool 1 has elongate tubular grip 2, driving ram 3 and frictional element 4. FIG. 1 shows tool 1 as it might appear when employed to drive a fastener into an overhead corner location at an angle to the work. It should be noted that particularly in such situations frictional element 4 will serve to maintain ram 3 in contact with fastener 5 when in the absence of frictional element 4 ram 3 could be expected to rebound or slide out of contact with fastener 5. FIG. 2 shows tool 1 engaged with partially driven fastener 5. Fastener 5 is in contact with nail engaging end 6 of ram 3. Blow receiving end 7 of ram 3 is displaced from grip 2 a distance equal to the distance from the fastener contacting face of nail engaging end 6 to the nail end of grip 2. It can be seen from FIG. 2 that the user can readily determine the distance fastener 5 is yet to be driven before its head will be driven flush with the work surface by observing the displacement of blow receiving end of ram 3 from the blow end of grip 2.

Figure 3:
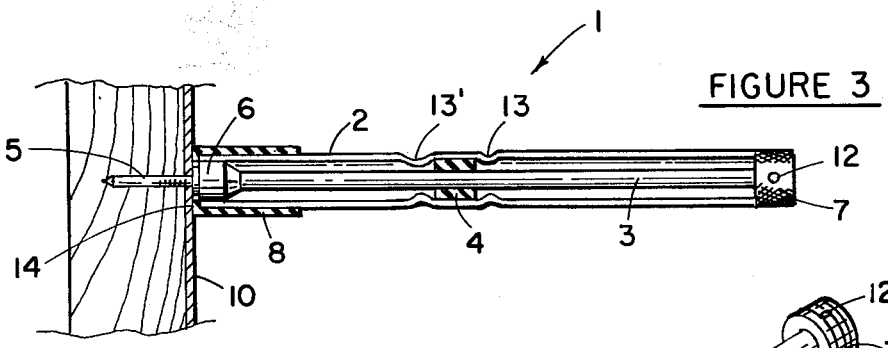
FIG. 3 is a sectional view of a preferred embodiment of the tool of FIG. 1 after the fastener has been fully driven.
Figure 4:
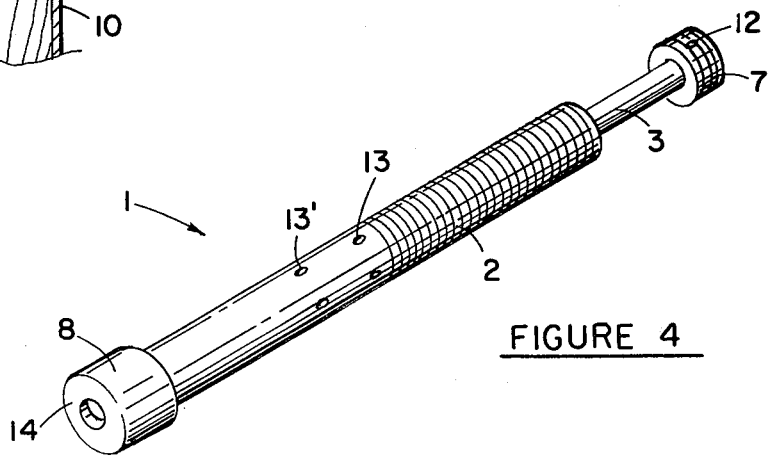
FIG. 4 is a pictorial view of the tool of FIG. 3.

In FIGS. 3 and 4 tool 1 is provided with a cushioning cap 8 of resilient material. Cap 8 serves to prevent marring of the work surface such as surface 10 of FIG. 3. Cap 10 also serves to prevent the driving of the head of fastener 5 flush with surface 10 which could dent or mar or otherwise damage surface 10. Face 14 of cap 8 thereby serves to limit the depth to which fastener 5 may be driven by tool 1.

Tool 1 will serve for driving most sizes of fasteners and is therefore general in its application. It is practical and economically possible to provide a larger or a smaller tool made according to this invention for situations where such a tool is frequently needed to drive large or small fasteners. While the following example enables the forming of a general utility tool made according to this invention the scope of the invention should not be limited to that of the example.

EXAMPLE

Tool 1 may have an overall length in the order of 8 inches and an outside diameter in the order of ½ inch. Grip 2 may be of steel and have an inside diameter in the order of ⅜ inches. Ram 3 may be of steel and be formed by conventional means from a single piece of stock or alternatively ram 3 may be formed of multiple pieces for economy and/or convenience and the pieces substantially permanently assembled with one another. The use of pin 12 of FIG. 3 to join blow receiving end 7 to ram 3 is an example of such an assembly. Sleeve 4 may be of rubber, plastic or a composition material which will provide sliding friction between the sleeve and the ram and/or the sleeve and the grip. Detent 13 may be formed in grip 2 by stamping, punching, rolling or any conventional means. Detent 13 may be a ring of dimples such as those illustrated in FIG. 2 or detent 13 may have more than one row of deformations projecting inwardly along the length of grip 2 such as those illustrated by detents 13 and 13' of FIG. 3 where the detents serve the added utility of limiting the axial travel of sleeve 4. The exact dimensions, materials of fabrication, and the manner of achieving the unitary construction of the instant invention and within the scope of the invention, are to some extent a matter of design choice.

The inventor has provided an enabling disclosure and specification for his fastener driving tool of simple, economical, sturdy, and durable unitary construction. He has provided, by example, disclosure of preferred embodiments of his invention. However, it should be understood that the scope of the invention should be limited only by the scope of the appended claims and to all equivalents thereto which would become apparent to one skilled in the art.

I claim:

1. A fastener driving tool of the type having a round tubular grip and a ram which is drivable within the grip and comprising; a unitary construction characterized by;

(1) an elongate circular tubular grip having a nail end and a blow end and having at least one integral detent projecting inward along the midsection of the grip, (2) an elongate cylindrical ram having a diameter smaller than the inside diameter of the grip and the ram being terminated at one end by an integral cylindrical nail contact end of a diameter providing a sliding fit with the inside diameter of the grip and the ram being terminated at the other end by an integral blow receiving end having a diameter larger than the inside diameter of the grip, and (3) a sleeve member which is engaged with the inside of the grip between the nail end of the grip and the detent and the sleeve serves to maintain frictional engagement between the ram and grip in a unitary construction.

2. The driving tool of claim 1 wherein the grip and ram are fabricated of steel and the sleeve is fabricated of rubber and the detent is formed by punching.

3. The tool of claim 2 wherein the ram is formed from a single piece of steel and the length of the ram is equal to the length of the assembled tool when the blow receiving end of the ram is in contact with the grip.

4. The tool of claim 3 wherein the tool is provided with a resilient detachable cap-like guard having a face the thickness which defines the depth to which a fastener may be driven by the tool.

* * * * *